US007222741B2

(12) United States Patent
Chmela et al.

(10) Patent No.: US 7,222,741 B2
(45) Date of Patent: May 29, 2007

(54) TAMPER EVIDENT CAP

(75) Inventors: James S. Chmela, Algonquin, IL (US); John Chmela, Algonquin, IL (US); Richard Brandt, Crystal Lake, IL (US)

(73) Assignee: J.C. Products, Inc., Algonquin, IL (US)

( * ) Notice: Subject to any disclaimer, the term of this patent is extended or adjusted under 35 U.S.C. 154(b) by 488 days.

(21) Appl. No.: 10/350,584

(22) Filed: Jan. 24, 2003

(65) Prior Publication Data

US 2004/0144786 A1 Jul. 29, 2004

(51) Int. Cl.
*B65D 5/12* (2006.01)
*B65D 39/00* (2006.01)

(52) U.S. Cl. ..... 220/257.1; 220/257.2; 215/252; 215/254

(58) Field of Classification Search ..... 220/257.1, 220/257.2; 215/252, 254
See application file for complete search history.

(56) References Cited

U.S. PATENT DOCUMENTS 3,785,519 A * 1/1974 Huh ..... 215/254
4,520,942 A * 6/1985 Dwinell ..... 220/257.2
4,779,750 A * 10/1988 Armstrong ..... 215/254
5,119,955 A * 6/1992 Granofsky ..... 220/270
5,356,019 A * 10/1994 Kelly ..... 215/252
5,400,913 A * 3/1995 Kelly ..... 215/252
5,450,973 A * 9/1995 Ellis et al. ..... 215/252
5,695,083 A * 12/1997 Obadia ..... 215/329
5,749,484 A * 5/1998 Trout ..... 215/219
5,775,527 A * 7/1998 Bosl et al. ..... 215/252
5,996,833 A * 12/1999 Lencioni et al. ..... 220/257.2
6,491,175 B1 * 12/2002 Taha ..... 215/252
6,543,634 B1 * 4/2003 Parrinello ..... 215/252
2001/0002661 A1 * 6/2001 Reidenbach
2003/0168456 A1 * 9/2003 Tomasella

* cited by examiner

*Primary Examiner*—Faye Francis
(74) *Attorney, Agent, or Firm*—Akerman Senterfitt; Stephan A. Pendorf; Yonghong Chen

(57) ABSTRACT

A tamper evident cover is provided for engaging a container cap or drum bung, which cover has a plurality of locking teeth that snap under and engage a lip of the container cap. A frangible strip permits severing the cover to facilitate removal of the cover, and a series of tabs extend from the locking teeth and bear against the outer edge of the lip of the container cap to prevent any forcible removal of the cover without substantial damage to or destruction of the cover.

12 Claims, 2 Drawing Sheets

TAMPER EVIDENT CAP

FIELD OF THE INVENTION

The present invention relates to tamper evident caps for containers and more particularly to a tamper evident dust cover for a drum bung. In particular, the invention relates to a tamper evident cover that is removable by pulling a tab that tears a strip off of the cover and partially divides the cover, thereby facilitating removal of the cover from the drum bung and destroying the cover so that it will be evident that it has been removed or tampered with.

BACKGROUND OF THE INVENTION

Vessels or drums of various sizes and shapes are used commercially to store, ship and dispense various substances. An opening is provided in the vessel or its lid to allow the vessel to be filled and to allow the contents of the vessel to be dispensed. The vessel opening is typically sealed with a removable bung or cap. The bung is typically threaded into the opening and forms a seal to prevent the contents from escaping from the vessel.

In order to provide an indication of prior access to the contents of the vessel, a tamper evident cover may be placed over the bung. Certain existing covers or other closures for this purpose use a tear strip along the skirt of the cover that must be removed to remove the cover. A pull-tab or ring is attached to the tear strip, and when the tab or ring is pulled, the tear strip is torn, and the cover may be removed from the vessel. A torn or missing tear strip evidences prior removal of the cover and possible tampering with the contents of the vessel.

An example of such a tamper evident cap is shown in U.S. Pat. No. 5,875,908 to Witt, et al. which shows a reusable bottle cap with a removable tamper evident tear strip or ring. In the Witt device, a plurality of teeth on the tear strip snap under a shoulder on the neck of a milk bottle so that the cap cannot be removed without first removing the tear strip. The tear strip is separable from the cap by a series of frangible tabs, and the tear strip includes a pull ring. When the pull ring is pulled to remove the tear strip, the tabs are broken in series, and the tear strip is separated from the cap. The tear strip is an open annulus so when it is separated from the cap, it can be removed from the bottleneck.

While this may have represented an improvement over former milk bottle closures such as friction fitted cardboard disks, crimped on aluminum foil caps, or crimped on paper caps, it does not provide a sufficient level of tamper evident security to meet current demands. Although the plurality of teeth of Witt will retain the cap and tear strip to the bottle, it is still possible to bend the individual teeth of the Witt device one at a time and effect removal of the cap without destroying the cap, thereby permitting removal and replacement of the cap without detection.

While this may not present a significant risk for a bottle of milk, it could be a concern for a larger container such as a drum that might contain a food product, perhaps in concentrated form that will be distributed to a large number of consumers, or it might contain a precious material, such as an expensive fragrance. In addition, with today's increased focus on security, even a humble milk bottle would benefit in the eyes of the consuming public from a higher level of security.

U.S. Pat. No. 5,944,229 to Rokkjaer discloses a tamper evident cap for a drum in which the cap has a ledge that snaps under a capturing surface on the drum. When a frangible strip is pulled, the cap is partially torn, and evidence of removal or possible tampering is provided. However, when the strip is removed, it is still necessary to compress the two severed halves of the cap together to effect release of the ledge from the capturing surface on the drum. With this arrangement, while a secure tamper evident cap is provided, the cap is difficult to install, and even more difficult to remove, requiring specific training of personnel at both the filling and dispensing ends of the shipping or storage cycle of the drum.

Another tamper evident cap for use with a drum is shown in U.S. Pat. No. 5,996,833 to Lencioni, et al. In that reference, a locking annular ring snaps under a lip formed on a neck of the drum, but must forced onto the neck with great effort with only two major and two minor slots to allow deformation of the ring to pass over the lip and into locked position.

SUMMARY OF THE INVENTION

It is therefore an object of the present invention to provide a novel tamper evident cover for a vessel closure that overcomes the problems experienced with prior devices.

Another object of the invention is to provide a tamper evident cover for a drum bung that is effective in operation and relatively inexpensive to manufacture.

A primary object of the invention is to provide a tamper evident dust cover for a drum bung that is reliable and effective in operation and is easy to install and remove without requiring special training of operating personnel.

These and other objects of the invention are achieved by providing a tamper evident cover for engaging a container cap or drum neck, which cover has a plurality of locking teeth that snap under and engage a lip of the container neck and a frangible strip that permits severing the cover to facilitate removal of the cover. In accordance with the present invention, a series of tabs extend from the locking teeth and bear against the outer edge of the lip of the container neck to prevent any forcible removal of the cover without substantial damage to or destruction of the cover. If desired, the tabs can be further retained in their locked position by cooperating retaining projections extending downwardly from the inside of the top of the cover.

In the preferred embodiment of the invention, the dust cover is formed of a single piece of molded plastic. The cover includes a top portion with an annular sidewall descending downwardly from the top, and the locking teeth are attached to the bottom edge of the sidewall by a living hinge so that they can be folded inwardly of the sidewall to engage and snap under the lip of the container neck. In its molded form, prior to engagement with the container or drum neck, the tabs extend further downwardly from the locking teeth so that when the teeth are folded inwardly to snap under the lip of the container neck, the tabs will extend along the entire length of the inside of the side wall, nearly touching the under side of the top of the cover. In this position, the tabs also bear against the outer edge of the lip of the neck, making it impossible to bend the teeth back outwardly to remove the cover without significantly damaging or destroying the cover. As a significant advantage, this construction permits the cover to be molded easily, straight up and down, without any undercuts in the mold, thereby providing a tamper evident cover that provides superior performance and can be manufactured very efficiently and inexpensively.

These and other aspects of the invention will be more apparent from the following description of the preferred embodiments thereof when considered in connection with the accompanying drawings and appended claims.

BRIEF DESCRIPTION OF THE DRAWINGS

The present invention is illustrated by way of example and not limitation in the accompanying drawings in which like references indicate similar parts, and in which.

DETAILED DESCRIPTION OF THE PREFERRED EMBODIMENT

Figure 1:
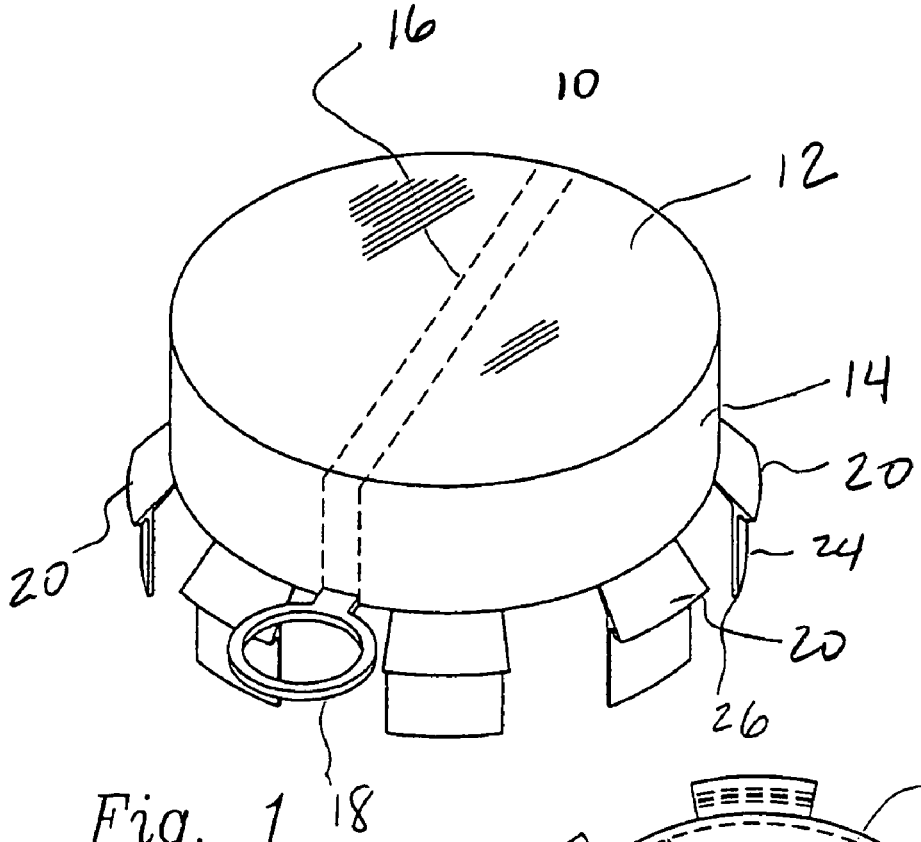
FIG. 1 is a perspective view of the tamper evident cover of the present invention shown in its manufactured, uninstalled position.
Figure 2:
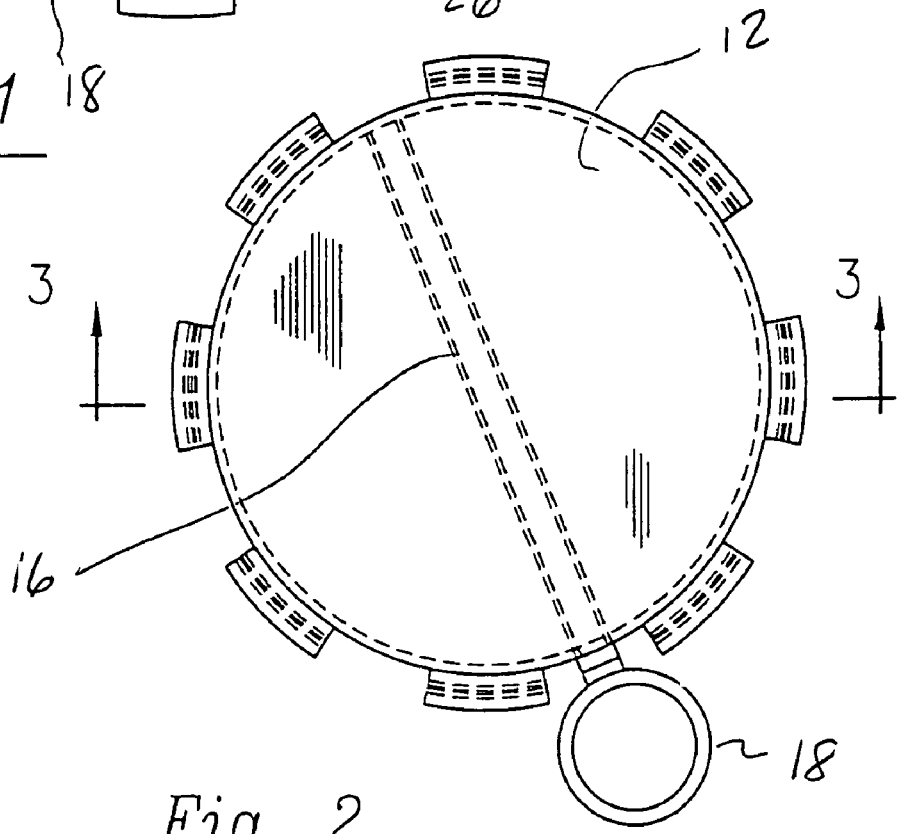
FIG. 2 is a top plan view of the tamper evident cover of FIG. 1.

A tamper evident cover for a drum bung or other vessel is shown generally at 10 in FIG. 1 and is comprised of a cap portion having a generally flat top 12 with an annular side wall 14 descending downwardly from the top. To permit removal of the cover after it has been installed on a drum neck or other vessel, a frangible strip 16 is provided across a portion of the sidewall 14 and across the top 12. To form the frangible strip 16, a pair of frangible lines are molded into the cover, and to facilitate separation of the strip 16 from the top 12, a pull tab or ring 18 is attached to the frangible strip 16.

Figure 3:
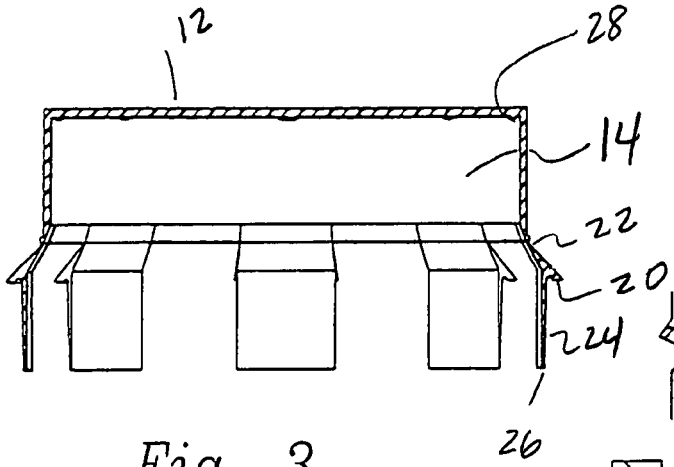
FIG. 3 is a sectional view of the cover of FIG. 2, taken along line 3—3 of FIG. 2.

Descending downwardly from the lower edge of the annular side wall 14 are a series of locking projections or teeth 20 that are each secured to the annular wall 14 by a flexible living hinge 22, as can best be seen in FIG. 3. As can be seen in FIG. 1, the frangible strip 16 extends vertically across the side wall in one location between two of the lockinig projections 20 and continues substantially entirely across the top 12. In accordance with the present invention, the series of locking teeth are each further provided with a downwardly projecting tab 24 that has a length allowing it to fold into the interior of the cover and very nearly reach the under side of the top 12. Tn addition, when the tab 24 is folded into the interior of the cover 10, the end 26 of the tab 24 passes over a retaining projection or stop 28 formed on the interior of the top 12. The end 26 of the tab 24 snaps into position between the stop 28 and the interior of the annular wall 14 and is thus restrained from returning to its original position. As will be apparent from the illustrations in FIGS. 1 and 3, this construction of the cover of the present invention permits the cover to be molded easily, straight up and down, without any undercuts in the mold, thereby providing a tamper evident cover that provides superior performance and can be manufactured very efficiently and inexpensively.

Figure 4:
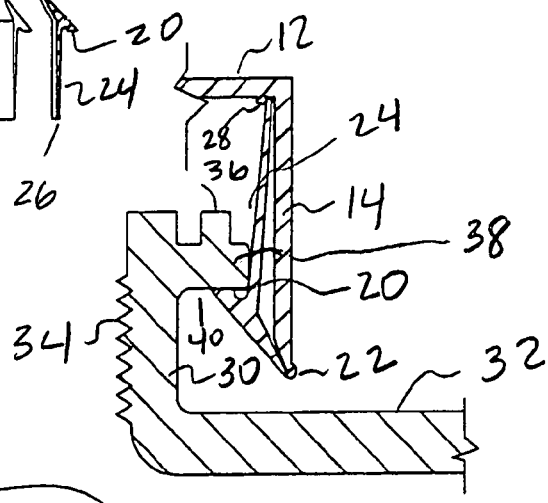
FIG. 4 is an enlarged, fragmentary, sectional view of a portion of the cover of the present invention, shown in its installed position in engagement with a drum or vessel opening.
Figure 5:
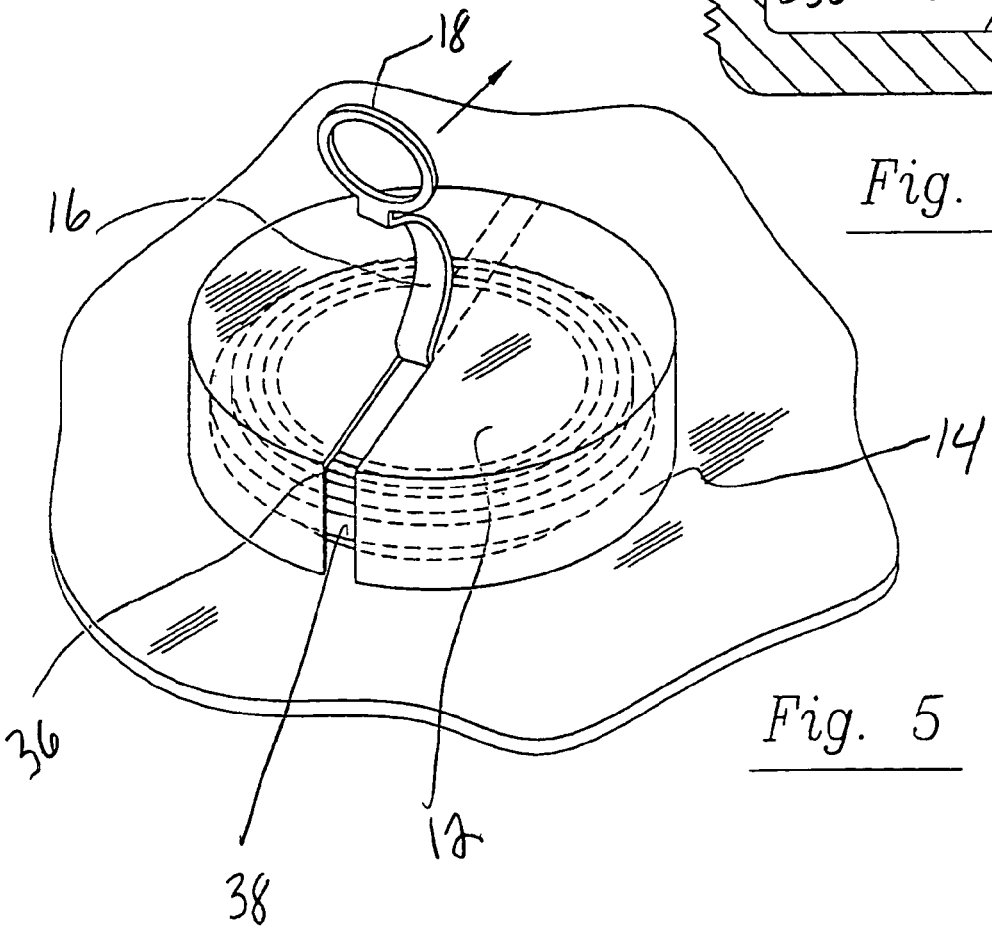
FIG. 5 is a perspective view of the cover of the present invention shown in its installed position as in FIG. 4, but illustrating the means employed for removal of the cover.

As can best be seen in FIG. 4, the cover 10 is shown in its installed position in cooperation with a neck 30 formed on the top 32 of a drum. The neck 30 forms the opening of the drum to permit the drum to be filled and to dispense product from the drum. For that purpose, the neck 30 is provided with internal threads 34 to receive an externally threaded drum bung (not shown). The neck 30 has a top surface 36 and is also provided with an annular lip 38 forming a capturing surface 40 on the underside of the lip 38.

In order to install the cover 10, the locking teeth 20 and tabs 24 are folded inwardly, and the cover 10 is brought into contact with the neck 30 so that the outer surface of the locking teeth 20 contact the top surface 36 of the neck 30. As the cover 10 is pressed down over the neck 30, the lip 38 forces the locking teeth 20 and the tabs 24 to fold further inwardly until the locking teeth 20 snap over the lip 38 and engage the capturing surface 40 under the lip 38. In this position, the outer edge of the lip 38 bears against the tab 24 to prevent the locking teeth 20 from folding back outwardly and releasing their engagement with the lip 38. Also in this position, the tab 24 extends along the entire length of the inner surface of the annular wall 14, and the end 26 of the tab 24 snaps over and is captured behind the stop 28 to further restrain the tab 24, and therefore the locking teeth 20, from disengaging from the lip 38.

With the cover 10 in the position shown in FIG. 4, the cover 10 cannot be removed from its engagement with the neck 30 without causing significant damage to the cover 10, thereby providing evidence that the cover has been removed. When it is desired to remove the cover 10 and gain access to the drum bung, the pull tab or ring 18 can be pulled to cause the frangible strip 16 to tear away from the top 12 and divide the top 12 so that the cover can be separated and removed from the neck 30. It should be noted that although the frangible strip 16 is illustrated as extending entirely across the top 12, it is sufficient if the strip 16 extends substantially entirely across the top surface 12. For example, if the strip extends only 90% of the distance across the top 12, or even merely 75% of the distance, dividing the top to that extent will still permit easy removal of the cover 10 from the neck 30, and will provide the required evidence of tampering.

With this arrangement, an extremely simple and effective tamper evident cover is provided that is easy to install, provides a very secure grip on the container opening while in place, and is also very easy to remove without undue training of the operating staff. In addition, with the particular geometry of the cover of the present invention, the cover is very simple and inexpensive to manufacture and can be easily molded as a single piece.

Various modifications and changes may be made by those having ordinary skill in the art without departing from the spirit and scope of this invention. Therefore, it must be understood that the illustrated embodiments of the present invention have been set forth only for the purpose of example, and that they should not be taken as limiting the invention as defined in the following claims.

The words used in this specification to describe the present invention are to be understood not only in the sense of their commonly defined meanings, but to include by special definition, structure, material, or acts beyond the scope of the commonly defined meanings. The definitions of the words or elements of the following claims are, therefore, defined in this specification to include not only the combination of elements which are literally set forth, but all equivalent structure, material, or acts for performing substantially the same function in substantially the same way to obtain substantially the same result.

In addition to the equivalents of the claimed elements, obvious substitutions now or later known to one of ordinary skill in the art are defined to be within the scope of the defined elements.

The claims are thus to be understood to include what is specifically illustrated and described above, what is conceptually equivalent, what can be obviously substituted, and also what incorporates the essential idea of the invention.

We claim:

1. A tamper evident cover for engaging a container cap comprising:

a cap portion having a top, a side wall descending downwardly from the top, an inner surface, and outer surface;

a frangible strip extending across a portion of said top;

a plurality of locking projections extending downwardly from said side wall and being hinged at the bottom edge of the side wall to move between a first position and a second position;

a tab extending downwardly from each of said locking projections, wherein each tab moves with said locking projections between the first and second positions, each tab having an end;

wherein the top of the cap further comprises an inner surface, an outer surface, and retaining projections located in the inner surface, said retaining projections extending downwardly from said inner surface of said top and adjacent to said side wall;

wherein in the second position, said tabs extend across said inner surface of said cap; and wherein in the second position said retaining projections engage said end of said tabs.

2. A tamper evident cover for engaging a container cap comprising:

a cap portion having a top, a side was descending downwardly from the top, an inner surface, and outer surface;

a frangible strip extending across a portion of said top;

a plurality of locking projections extending downwardly from said side wall and being hinged at the bottom edge of the side wall to move between a first position and a second position; and a tab extending downwardly from each of said locking projections, wherein each tab moves with said locking projections between the first and second positions, each tab having an end.

3. The tamper evident cover as in claim 2, wherein said top is round and said side wall is an annular wall.

4. The tamper evident cover as in claim 2, wherein said frangible strip extends vertically across the side wall in one location between two of said locking projections and continues substantially entirely across said top.

5. The tamper evident cover as in claim 2, further including means for pulling on said strip to permit said strip to sever said side wall and substantially all of said top.

6. The tamper evident cover as in claim 2, wherein in the second position, said tabs across said inner surface of said cap.

7. The tamper evident cover as in claim 2, further including means for causing said cap to be severed along said frangible strip to permit release of said locking projections and removal of said cover.

8. The tamper evident cover as in claim 2, wherein the top of the cap further comprises an inner surface, an outer surface, and a retaining projection located in the inner surface.

9. The tamper evident cover as in claim 8, wherein in the second position, the end of each tab passes over the retaining projection of the top of the cap.

10. The tamper evident cover as in claim 8, wherein the end of each tab snaps into a position between the retaining projection and the inner surface of the cap.

11. The tamper evident cover as in claim 2, wherein in the second position, each locking projection and corresponding tab fold inwardly into the inner surface of the cap.

12. The tamper evident cover as in claim 2, wherein the frangible strip extends across a portion of said side wall and across at least a portion of said top.

* * * * *